US008604907B2

(12) United States Patent
Ludwig et al.

(10) Patent No.: US 8,604,907 B2
(45) Date of Patent: Dec. 10, 2013

(54) MULTILAYER FLEXIBLE FILM BODY

(75) Inventors: Klaus Ludwig, Erlangen (DE); Wolfgang Clemens, Puschendorf (DE); Johannes Schad, Fürth (DE)

(73) Assignees: PolyIC GmbH & Co. KG, Furth (DE); Leonhard Kurz Stiftung & Co. KG, Furth (DE)

( * ) Notice: Subject to any disclaimer, the term of this patent is extended or adjusted under 35 U.S.C. 154(b) by 745 days.

(21) Appl. No.: 12/677,372

(22) PCT Filed: Sep. 11, 2008

(86) PCT No.: PCT/EP2008/007445

§ 371 (c)(1), (2), (4) Date: May 24, 2010

(87) PCT Pub. No.: WO2009/033662

PCT Pub. Date: Mar. 19, 2009

(65) Prior Publication Data

US 2010/0245112 A1 Sep. 30, 2010

(30) Foreign Application Priority Data

Sep. 12, 2007 (DE) ..... 10 2007 043 407

(51) Int. Cl.
*G08B 5/22* (2006.01)
*G09G 5/00* (2006.01)

(52) U.S. Cl.
CPC ..... *G08B 5/22* (2013.01)
USPC ..... 340/5.91; 340/572.1; 340/572.4; 340/5.92

(58) Field of Classification Search
CPC ..... G08B 5/22; G09G 5/00; G09G 3/34; G06K 19/06
USPC ..... 340/572.1, 572.4, 5.91, 5.92; 345/85, 345/2.3, 87, 107; 349/1, 201; 359/245, 558
See application file for complete search history.

(56) References Cited

U.S. PATENT DOCUMENTS 5,566,982 A 10/1996 Lehureau et al.
5,925,431 A * 7/1999 Schoenfelder ..... 428/40.1
6,318,760 B1 11/2001 Shadle et al.

(Continued)

FOREIGN PATENT DOCUMENTS

DE 69420213 T2 10/1999
DE 10046332 A1 4/2001

(Continued)

OTHER PUBLICATIONS

German Office Action in copending application.

(Continued)

*Primary Examiner* — Nam V Nguyen
(74) *Attorney, Agent, or Firm* — Carella Byrne et al.; Elliot Olstein; William Squire

(57) ABSTRACT

The invention concerns a multi-layer flexible film body (6), in particular a label film or packaging film as well as a goods identification system and uses of such a film body. The film body (6) has a carrier layer and a decorative layer system (11) which provides optically recognisable information. A plurality of layers of the decorative layer system form an electronically controlled display element (65), by the activation of which the optically recognisable information becomes visible.

25 Claims, 3 Drawing Sheets

(56) References Cited

U.S. PATENT DOCUMENTS

Figure 1:
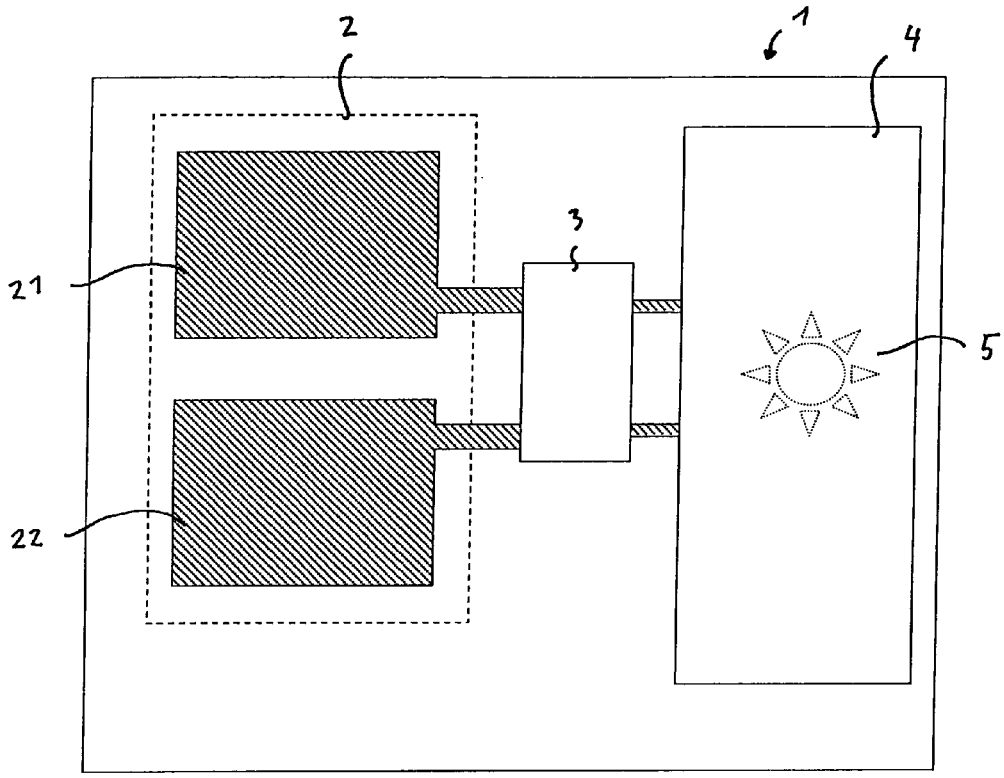

| | | | | |
|---|---|---|---|---|
| 6,369,793 | B1 | 4/2002 | Parker | |
| 6,639,578 | B1 * | 10/2003 | Comiskey et al. | 345/107 |
| 6,661,563 | B2 | 12/2003 | Hayashi et al. | |
| 6,924,781 | B1 * | 8/2005 | Gelbman | 345/85 |
| 7,393,452 | B2 * | 7/2008 | Tay et al. | 210/601 |
| 7,397,595 | B2 * | 7/2008 | Kojima | 359/271 |
| 7,709,865 | B2 * | 5/2010 | Clemens et al. | 257/288 |
| 7,774,606 | B2 * | 8/2010 | Jung et al. | 713/176 |
| 7,821,794 | B2 * | 10/2010 | Pennaz et al. | 361/761 |
| 7,865,734 | B2 * | 1/2011 | Jung et al. | 713/176 |
| 7,940,340 | B2 * | 5/2011 | Ludwig et al. | 349/1 |
| 2004/0051299 | A1 | 3/2004 | Shadle et al. | |
| 2004/0156418 | A1 | 8/2004 | Debord et al. | |
| 2008/0035736 | A1 | 2/2008 | Tompkin et al. | |
| 2008/0198278 | A1 | 8/2008 | Ludwig | |
| 2009/0045918 | A1 | 2/2009 | Droesler et al. | |
| 2009/0237248 | A1 | 9/2009 | Clemens | |

FOREIGN PATENT DOCUMENTS

| | | | |
|---|---|---|---|
| DE | 20314902 | U1 | 1/2004 |
| DE | 102004049139 | A1 | 4/2005 |
| DE | 102004045211 | A1 | 3/2006 |
| DE | 102005029420 | A1 | 12/2006 |
| DE | 102005030626 | A1 | 1/2007 |
| DE | 102005052070 | A1 | 5/2007 |
| DE | 102006001487 | A1 | 7/2007 |
| DE | 102006001854 | A1 | 7/2007 |
| DE | 102006008345 | B3 | 8/2007 |
| DE | 102006010159 | A1 | 9/2007 |
| EP | 0634732 | B1 | 1/1995 |
| EP | 1813440 | A1 | 8/2007 |
| EP | 1881400 | A1 | 1/2008 |
| JP | Sho 61-059589 | | 3/1986 |
| JP | 11-24062 | | 1/1999 |
| JP | P2000-147536 | A | 5/2000 |
| WO | 0005701 | A1 | 2/2000 |
| WO | 2006029857 | A2 | 3/2006 |
| WO | 2006110622 | A2 | 10/2006 |

OTHER PUBLICATIONS

International Search Report of copending application dated Dec. 20, 2009.

* cited by examiner

MULTILAYER FLEXIBLE FILM BODY

The invention concerns a multi-layer flexible film body, in particular a label film or a packaging film, comprising a carrier layer and a decorative layer system providing optically recognisable information, and uses of such a film body and a system including such a film body.

For packaging goods, for example foodstuffs, use is usually made of composite materials which, besides a carrier film, have a decorative layer which imparts a pleasing visual impression to the packaging. Thus for example DE 203 14 902 U1 describes a multi-layer packaging film for foodstuffs, which has a packaging carrier layer, a flat advertising-carrying carrier layer and an advertising-carrying printing thereon.

Now the object of the invention is to provide an improved multi-layer flexible film body and uses of such a film body, which in particular can be used as a label film or a packaging film.

That object is attained by a multi-layer flexible film body comprising a carrier layer and a decorative layer system which affords optically recognisable information, in which a plurality of layers of the decorative layer system form an electrically controlled display element, by the activation of which the optically recognisable information becomes visible.

The invention makes it possible to provide a packaging with novel optical effects, to provide optical dynamic labels having novel functions and to integrate additional functions in packaging systems.

Advantageous developments of the invention are set forth in the appendant claims.

Preferably the decorative layer system includes one or more layers which provide a sensor element for detecting an external activation signal, wherein the sensor element is connected to the display element directly or by way of an electronic circuit. Upon reception of the activation signal the display element is activated and the optically recognisable information of the decorative layer system is rendered visible. In that respect the following energy sources and influences can be used as activation signals for activation of the display element: alternating electromagnetic field, in particular HF or RF field senders, sound, temperature, conductivity, air humidity, pressure, capacitance and light. In that case the decorative layer system has respectively one or more layers which provide a sensor element for detecting those energy sources and influences. Thus it is possible for example for the optical action of the decorative layer system to be activatable by an alternating electromagnetic field as the external activation signal and for the decorative layer system to include one or more electrically conductive layers forming antenna structures for detecting the alternating electromagnetic field and which serve as the sensor element for detecting the alternating electromagnetic field. In that case antenna structures which are suited to the frequency range which is respectively used are employed as antenna structures, for example coil-form antennas, dipole antennas, bipole antennas or capacitive coupling structures.

In accordance with a preferred embodiment of the invention the optical effect of the decorative layer system is activated by an alternating electromagnetic field as the external activation signal and the decorative layer system has one or more electrically conductive layers at least region-wise of a plate-shaped configuration for capacitively coupling in the alternating electromagnetic field, which serve as the sensor element for the detection of the alternating electromagnetic field. Such coupling-in of the activation signal represents a particularly robust solution which permits selective and targeted activation of the film bodies.

In accordance with a further preferred embodiment of the invention the display element or the electronic circuit is of such a configuration that the display element remains activated after first activation, and preferably activation of the display element can no longer be reversed. After activation the optically recognisable information thus remains permanently visible. That can be achieved on the one hand by the use of monostable display elements, and on the other hand also by an electronic circuit which, after reception of the activation signal, keeps the display element permanently in the activated state.

In addition it is also possible for the decorative layer system to include one or more layers which provide a sensor element for detecting an external deactivation signal and for the sensor element to be connected to the display element directly or by way of an electronic circuit, so that the display element is deactivated upon reception of the deactivation signal. In addition it is also possible for the display element to remain activated only as long as the activation signal is detected by the sensor element.

In accordance with a further preferred embodiment of the invention the multi-layer body has a switching element which activates the display element after a predefined time expiration. The appearance of the decorative layer system thus changes with the time expiration. With this embodiment it is thus also possible to dispense with a sensor element for detecting an external activation signal.

Preferably the decorative layer system has one or more layers providing an electrical power source. In that case the electrical power source is connected to the display element directly or by way of a switching element. The decorative layer system thus preferably has two or more layers providing an electrochemical flat battery as the electrical power source. In addition it is for example possible for the decorative layer system to have one or more electrically conductive layers which are at least region-wise shaped in the form of a flat coil for inductively coupling in energy from an alternating electromagnetic field, wherein the flat coil is connected to a tuning capacitor and a rectifier as the power source for generating a direct current. In addition it is possible for the decorative layer system to have one or more electrically conductive layers which are shaped at least region-wise in the form of plate-shaped metal surfaces for capacitively coupling in energy from an alternating electromagnetic field, wherein the plate-shaped metal surfaces are connected to a rectifier and a capacitor as the power source for generating a direct current. Further possible options provide that the decorative layer system has one or more layers having preferably organic solar cells as the power source, or it has one or more layers comprising a piezoelectric material which for example upon folding or bending or under the action of heat or cold of the film body, generate a voltage pulse which is detected by the corresponding electrode layers and stored by a capacitor. A further possible option provides that the decorative layer system as the power source has one or more electrodes for receiving charge carriers generated by friction and electrostatic charging. Preferably in that case the decorative layer system has a capacitor which serves as an energy storage means and which is charged up by the above-described power sources and which is connected directly or indirectly to the display element.

In addition it is also possible to use a power source combined from two or more of the above-mentioned power sources, for example a piezoelectric element or a solar cell with a battery.

In accordance with a preferred embodiment of the invention provided between the power source and the display element is an electronic circuit which inter alia can include a switching element which makes or breaks the connection between the power source and the display element. In that case the electronic circuit is preferably formed by two or more layers of the decorative layer system which, including an organic electronic circuit, provides one or more semiconductor layers applied from a solution. In that case the electronic circuit is connected on the one hand to the power source and on the other hand to the display element and controls activation of the display element. In that case preferably organic field effect transistors are used as the switching element.

In a preferred embodiment of the invention the decorative layer system has two electrode layers and one or more layers arranged between the electrode layers, containing a nematic or cholesteric liquid crystal material, an electrochromic material, an electroluminescent material or an organic (or inorganic) fluorescent material, which provide the electrically controlled display element. The display element can thus have for example spheres which are enclosed in a polymer matrix and which are filled with liquid crystal and which can be oriented by an electric voltage and which can thus be switched from opaque to transparent. In that respect it is also possible to use cholesteric liquid crystal materials. When using electrochromic materials the colour of the display element changes when the dye is reduced by an electrochemical reaction. In the case of an electroluminescent material phosphorus is excited to light up by way of an alternating electrical field. In addition it is also possible to use coloured electric particles which are arranged between two electrodes and which are moved by way of electrostatic forces so that they are visible or invisible to the viewer. Furthermore it is also possible to provide between two electrodes a coloured liquid which is modified in form by way of electrostatic forces and thus becomes visible or invisible. It is also possible to use organic light emitting diodes as the display element, in which case organic florescent substances are excited to light up by a current. In addition it is also possible for the decorative layer system to have a thermochromic layer which is arranged in the decorative layer system in adjacent relationship with an electric heating element, for example a conductor track arranged in a meander configuration. When a voltage is applied to the heating element it heats up and the thermochromic material of the thermochromic layer changes its colour. It is thus possible to use energy-activated, monostable or bistable display elements.

Preferably in that respect one or more layers of the display element are shaped in the form of the optically recognisable information so that, upon activation of the display element, the optical effect of the decorative layer system changes in that region and the optically recognisable information becomes visible.

It is however also possible for the optically recognisable information to be formed by one or more layers which are preferably of a coloured nature and which are arranged from the point of view of the viewer above or beneath the display element and which become visible to the viewer upon activation of the display element, for example by those layers no longer being covered for the viewer or becoming visible by virtue of a change in the background.

In addition it is also possible for one or both of the electrodes of the display element to be formed by an unstructured electrode layer which is structured by overprinting with an electrically non-conducting printing material in negative form in respect of the optically recognisable information, in such a way that the electrodes have an electrically conductive surface only in the region of the optically recognisable items of information, which surface is in contact with the electrochromic material, the electroluminescent material or the organic/inorganic fluorescent material. It has proven to be particularly advantageous in that respect for a thermotransfer wax to be used as the insulator for such structuring of the electrode layer or the electrode layers. In that respect, mixtures based on various waxes and resins with a dropping point of 90 to 110° C. and a solidification point of 75 to 85° C. and a viscosity of 50 to 100 μPa at 100° C. have proven to be particularly suitable. The wax layer is applied by printing to the electrode layer by means of a thermotransfer printer. In that case, the thermotransfer printer is fed with a thermotransfer film having a carrier film and a wax layer applied thereto and consisting of a thermotransfer wax. The thermotransfer wax layer is melted region-wise by a thermotransfer printing head which is actuated digitally and in that case a respective small region of the transfer layer of the thermotransfer film is transferred onto the electrode. In that transfer procedure adjacent regions of the regions of the thermotransfer wax layer transferred onto the electrode melt so that on the one hand the thermal loading on the decorative layer system remains low and reliable insulation of the deactivated regions of the electrode—including in the edge regions of the electrode—is achieved. Further advantages are afforded by virtue of the fact that the thermotransfer layer has particularly good resistance in relation to the photoactive materials used by the display element, for example luminescent materials, organic or inorganic florescent substances, and thus the fail-safe nature of the display element is improved by the use of such an insulator layer.

In addition it is also possible for the decorative layer system to provide two or more different optically recognisable items of information and for the plurality of layers of the decorative layer system to provide two or more electrically controlled display elements, by the respective activation of which one of the different optically recognisable items of information is rendered visible.

Preferably the film body is used as an optically dynamic label in an overall system.

That system comprises a radio activator and a multiplicity of optically dynamic labels which, by virtue of the inexpensive production thereof, can be used for marketing purposes on a multiplicity of products. The optically dynamic labels can be applied for example in the packaging industry for instance to potato chip bags. When the display element is activated various items of information such as images or numbers for a lottery can be concealed behind the display. Thus for example packages are distributed, on which there is a respective activatable logo in the form of optically recognisable information which can be rendered visible. Only a limited number of variations in that logo is provided (for example heart, star, champagne glass). There are thus provided two or more different groups the same activatable item of information which differs from the activatable of packagings, wherein the packagings in the same group respectively have item of information of the other group. In addition it is also possible to provide a further group of packagings which have an optical appearance corresponding to the non-activated optically dynamic label, but do not have an electrically controlled display element. The chances of winning can be restricted by means of such "dummies".

In addition it is also possible for the film body according to the invention to be used for tickets, trade mark protection elements (for example labels), lottery tickets, playing cards or other games or to be in the form of an RFID tag with additional optical items of information.

The electrically controlled display elements can also be segmented, for example to constitute a 7-segment element (representation of digits or letters). In addition it is also possible for a plurality of electrically controlled display elements to be provided in mutually juxtaposed relationship, which become visible upon activation of various logo elements or information elements.

The display elements can be of such a configuration that the optically recognisable information flashes only upon direct activation (for example by pressing on a push button or by direct action of an alternating electromagnetic field) or also—in relation to various display elements—those elements are activated successively and thus the respective items of information are successively rendered visible. Furthermore the display elements can also be permanently activated and the information can thus remain permanently visible by one-off activation or it can be switched back again by a reset signal.

The logos can be activated for example at the location of the manufacturer in the context of a lottery game by the activator which for example emits a predefined alternating electromagnetic field.

In addition the optically dynamic label can also be used as a payment means. Thus for example the logo can be activated and rendered visible at the till after payment. After the goods are handed over the symbol is deactivated again. That procedure can be repeated. The display element can also be permanently activatable, that is to say the information is maintained once the display element has been activated.

In addition the multi-layer body according to the invention can also serve as intelligent and interactive operating instructions. For example additional items of information relating to the product, associated implementation or its usability can be integrated by activation.

In addition the multi-layer body according to the invention can serve as a security feature for identifying the authenticity of products. The manufacturer can see by activation whether the product is a pirated product or not or in relation to warranty cases or upon the disposal of products can establish whether the goods actually originated from him and whether he is or is not obliged to provide customer services.

Furthermore the film body according to the invention can also be used as a label for monitoring electronic components. In electronics, certain components are not to be exposed to strong electrical or magnetic fields. To check the compliance with those requirements a multi-layer body according to the invention can be applied as an indicator to such products or the packaging thereof. In that case the film body has a sensor element for detecting the electrical or magnetic fields and the display element is activated as soon as the predefined limit values are exceeded.

In addition the film body according to the invention can also be used as a label for monitoring foodstuffs and for that purpose can be applied to the foodstuffs or the packaging thereof. In that case the film body has for example sensor elements for detecting the temperature of the foodstuffs (cool chain), for monitoring the light-exposure duration (for example UV sensitive products) or sealing integrity of the packaging (detecting the oxygen content, nitrogen content, water, etc.). When the predefined limit values are exceeded the display element is activated and the information, for example a warning indication, is rendered visible.

A further area of use for film bodies is represented by so-called "life style goods".

It is thus for example possible for the film body to form an interactive poster in relation to which a change in a layout or graphics of the poster can be defended against by an activation signal. Other uses exhibiting interactive characteristics are also possible, for example integration of the film element in a T-shirt (or other articles of clothing), a bracelet or armband, a clock or watch or a pendant, in which case also the optical display element can be specifically and targetedly activated.

The film body according to the invention can also be in the form of a label stuck on packagings or surfaces. In addition there is the possibility of the film body being pushed into a package. In addition there is the possibility of an opening corresponding to the dimensions of the display element being for example stamped out in the package and for the film body to be fixed from behind in accurately fitting relationship with the opening on the package, for example being glued thereto. In that case the display element is preferably matched in colour to the package or surface. Furthermore it is also possible for the film body itself to represent a packaging film for packages and for the display element and further components (power source, electronics, sensor element) to be applied by printing processes during manufacture of the packaging film. Preferably in that case the film body according to the invention is produced in a roll-to-roll process substantially by means of printing methods.

The invention is described by way of example hereinafter by means of a number of embodiments by way of example with reference to the accompanying drawings.

Figure 2:
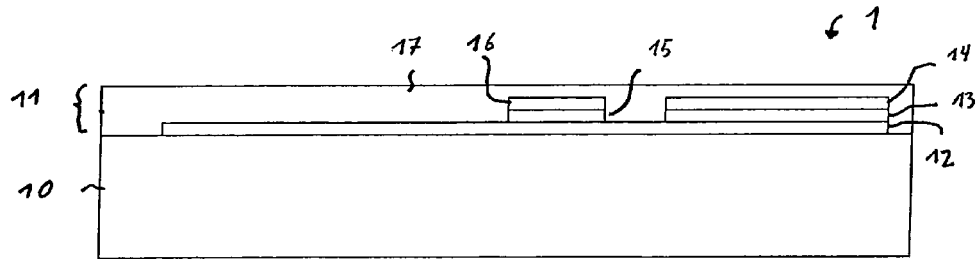
Figure 1A:
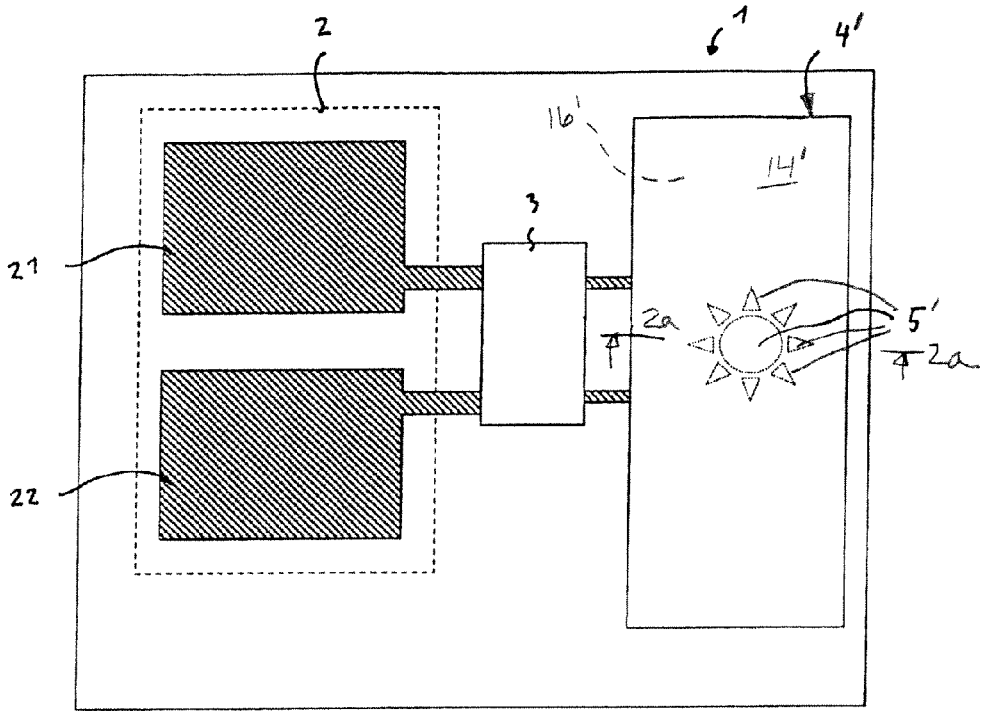
Figure 2A:
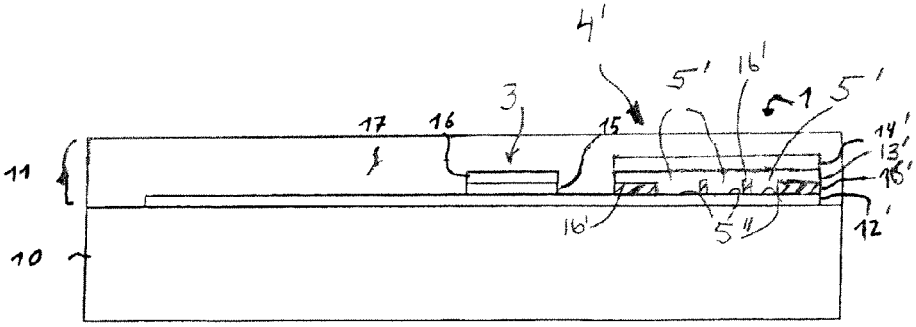
Figure 3:
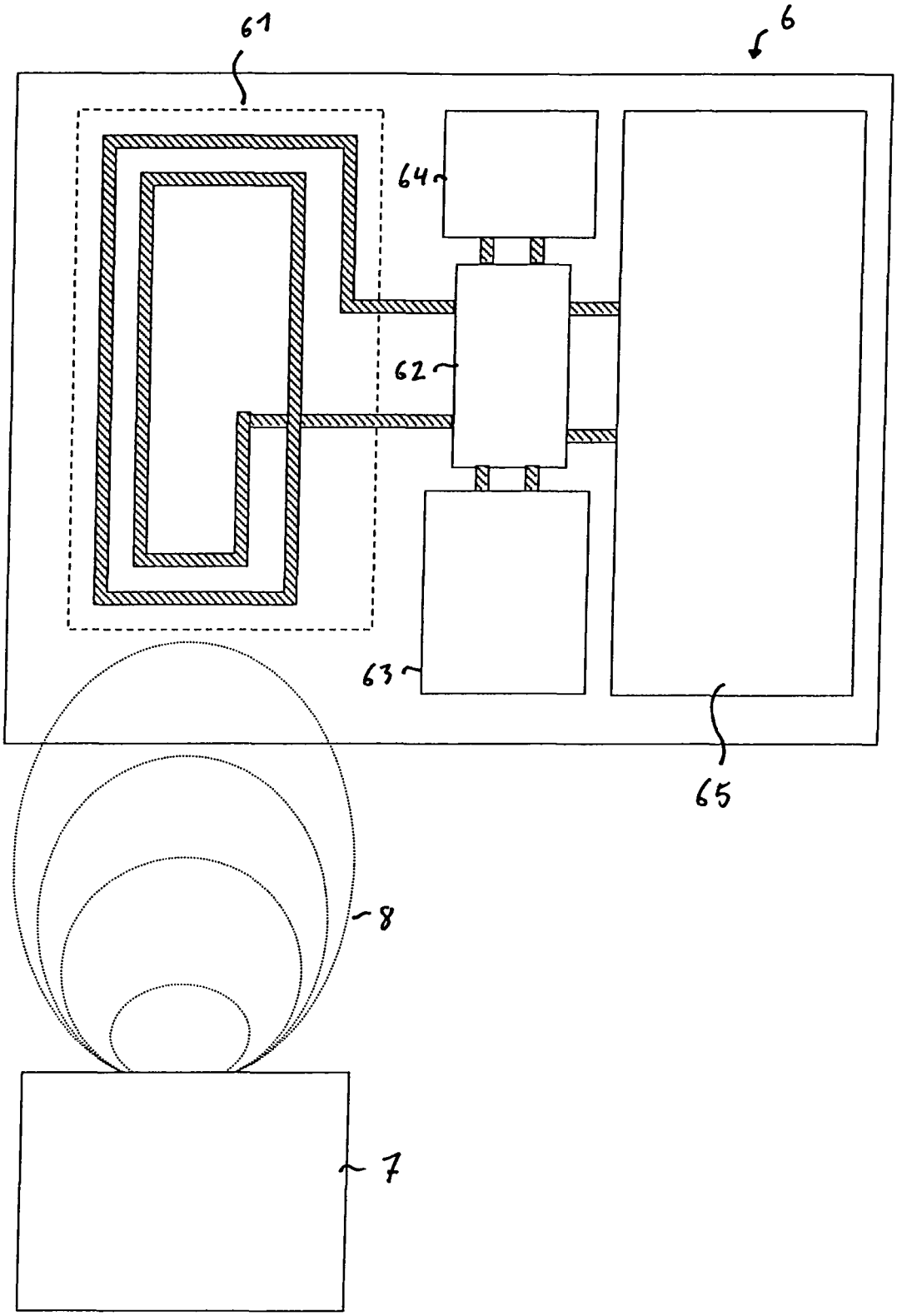

FIG. 1 shows a diagrammatic view of a film body according to an embodiment of the invention, FIG. 2 shows a diagrammatic view in section of the film body of FIG. 1, FIG. 1*a* illustrates a further embodiment of the invention, FIG. 2*a* shows a diagrammatic view in section of the film body of FIG. 1*a* taken along lines 2*a*-1*a* of FIG. 1*a*, and FIG. 3 shows a goods identification system comprising an activator and a film body according to the invention.

FIGS. 1 and 2 show a film body 1 having a carrier layer 10 and a decorative layer system 11. In that case, besides the carrier layer 10 and the decorative layer system 11, the film body 1 can have still further layers, for example adhesive layers, protective layers or bonding primer layers.

The carrier layer 10 is preferably a plastic film, in particular of polyester, polyethylene, polycarbonate, polypropylene, polyetheretherketone ketone, polyetheretherketone, polyamide, polyphthalamide, syndiotactic polystyrene, polyvinylidene difluoride, polytetrafluoroethylene, of a layer thickness of 12 to 100 μm.

The decorative layer system 11 comprises a plurality of layers which are preferably applied in structured form by means of a printing process, for example intaglio printing or tampon printing, in a roll-to-roll process.

FIG. 2 shows here by way of example a plurality of electrically conductive layers 12, 14 and 16, a layer 13 of an optically active material and a layer 15 of electrically non-conductive material. Those electrical functional layers are encapsulated by means of a protective layer 17.

In FIG. 2*a*, the electrode 12' of the display element 4' of this embodiment is formed as a n unstructured electrode layer structured by overprinting with an electrically non-conducting printing material 16' in negative form in respect of the optically recognizable information 5', such that the electrode 12' has an electrically conductive surface 5" only in the region of the optically recognizable items of information, which surface is in contact with the one of the electrochromic material, the electroluminescent material or the organic/inorganic fluorescent material 13'.

In a first region the electrical functional layers of the decorative layer system 11 are adapted to provide a sensor element 2 serving to detect an alternating electromagnetic field. Thus in the region of the sensor element 2 the electrically conducting functional layer 12—as indicated in FIG. 1—is shaped in the form of two plate-shaped metal surfaces 21 and 22 which serve for capacitively coupling the alternating electromagnetic field into the film body 1.

In a further region of film body 1 the electrical functional layers of the decorative layer system 11 are arranged and shaped to provide an organic electronic circuit. Thus the FIG. 1 embodiment has an electronic circuit 3 connected on the one hand to the sensor element 2 and on the other hand to a display element 4 by way of electrically conducting connecting paths. The electronic circuit 3 has a rectifier made up of one or more organic diodes or field effect transistors and a smoothing capacitor connected on the output side thereof, and thus converts the alternating electromagnetic field which is capacitively coupled in by way of the capacitor plates 21 and 22 into a dc voltage signal. In the region of the electronic circuit 3 the decorative layer system 11, besides the layers 16, 15 and 12 forming the smoothing capacitor, also has further layers (not shown here), in particular electrically conductive layers and electrically semiconductor layers, which represent functional layers of the organic field effect transistors or organic diodes, which provide the rectifier. In addition it is also possible for the electronic circuit 3 to include still further components, for example a switching element, which controls the supply of current to the display element, or a logic circuit which for example decodes information modulated onto the coupled-in alternating electromagnetic field and/or detects signals from further sensor elements, logically links those items of information and, when predefined conditions are met, causes activation of the display element by means of the switching element. Those components are also made up by the arrangement and shaping of electrical functional layers including electrically conducting functional layers, electrically semiconducting functional layers and electrically non-conducting functional layers, by means of which preferably substantially by means of printing processes, an electronic circuit is constructed, based on organic field effect transistors, capacitors and resistors.

The electrically conductive layers 12 and 14 and functional layer 13 forming the display element are arranged in the region of the display element 4 in the decorative layer system 11. The functional layer 13 comprises a material which, upon the application of an electric field or in relation to an electric current flow, alters its optical properties. The layer 13 thus comprises for example a polymer matrix having cavities filled with a nematic or cholesteric liquid crystal material so that upon the application of an electric field there is a change in the optical appearance of the layer 13. The layer 13 can also comprise an electrochromic material, an electroluminescent material, an electrophoretic material or an organic fluorescent substance, in which case also still further layers can be provided between the layers 12 and 13. One or more of the layers 12, 13 or 14 are shaped in the region of the display element 4 in the form of an optically recognisable item of information so that, upon activation of the display element 4, that is to say upon the application of a voltage to the connecting contacts of the display element 4, the optical appearance of the display element 4 changes in the region of the optically recognisable information and the optically recognisable information 5 thus becomes optically visible.

The electrically conductive functional layers used are preferably thin metal layers in the thickness range of between about 1 and 5 nm, comprising for example copper, aluminium, silver, gold or a metal alloy. It is also possible for the electrically conducting functional layers—particularly in the region of the display element 4—to comprise a transparent conductive material such as ITO or $TIO_x$ or an organically conductive material such as PEDOT/PSS, Pani or Carbon Nanotubes.

The electrically semiconducting functional layers of the decorative layer system 11 preferably comprise an organic semiconductor, for example polythiopen, polyterthropen, polyfluorene, pentacene, tetracene, oligotropen, inorganic silicon embedded in a polymer matrix, nano-silicon or polyarylamine or Carbon Nanotubes. The layer thickness of the organic semiconductor layer is preferably between 5 nm and 1 μm. The semiconductor layer is applied from a solution, for example an aqueous solution, by means of a printing process, for example an intaglio printing process or a tampon printing process, or also by means of spin coating, spraying or pouring.

In addition the electrically semiconducting functional layer can also be made from a layer comprising substantially inorganic substances which are applied from a solution. Thus the layer can comprise a layer, applied out of a solution, of an inorganic semiconductor, for example of nano-particles of an inorganic semiconductor, for example silicon, which are applied out of a solution by means of one of the above-listed processes, in a layer thickness of between 5 nm and 1 μm.

The electrically non-conducting functional layer of the decorative layer system 11 is preferably a layer of a polymer material, for example polymethylmethacrylate (PMMA), PVP, PHS, PS, polystyrene copolymers, urea resins or PMMA copolymers, in a layer thickness of 5 nm to 16 μm. That layer is preferably also applied out of a solution by means of one of the above-identified processes, in particular by means of offset printing, inkjet printing, intaglio printing or screen printing or flexoprinting.

It is also possible for the decorative layer system 11 to be produced not in a single continuous production process but for individual components of the decorative layer system 11, for example the electronic circuit 3 and/or the display element 4 to be produced separately in a roll-to-roll process and then for example applied to the electrically conducting functional layer 12 and electrically connected to the corresponding other components by means of an electrically conductive adhesive.

The film body 1 shown in FIG. 1 is individually separated off after manufacture and applied for example in the form of a label to a playing card. In that case the film body 1 forms part of a system which includes a multiplicity of further playing cards also provided with a film body designed as shown in FIG. 1, the display elements of which however provide optical information which differs from the optical information, and also have an activator tuned to the sensor 2. In that case the activator also has two plate-shaped metal surfaces tuned to the metal surfaces 21 and 22. With suitable overlapping of the mutually associated plates of the activator and the respective playing card, that involves coupling-in of the alternating electromagnetic field which is rectified by the electronic system 3 and converted into a dc voltage which activates the display element 4 and renders the information visible.

FIG. 3 shows a goods identification system comprising an activator 7 and a film body 6. The film body 6 is constructed like the film body 1 shown in FIGS. 1 and 2 with the difference that the arrangement and shaping of the electrical conductive, electrically semiconducting and electrically insulating layers of the decorative layer system 11 in the film body 6 provide for implementation of functions different therefrom in the decorative layer system. Thus the film body 6 has a sensor element 61, a sensor element 64 an electronic circuit 62, a power source 63 and a display element 65 which are designed as described above by virtue of the arrangement and shaping of the layers of the decorative layer system.

The sensor element 61 is formed by an antenna coil which is tuned to detection of an alternating electromagnetic field 8 emitted by an activator 7. The power source 63 is an electrochemical flat battery produced by means of printing.

The sensor element 64 is a temperature sensor which is formed for example by an arrangement comprising two electrodes and a semiconductor arranged between the electrodes, with suitably temperature-dependent conductivity. The display element 65 is designed for example like the display element 4 in FIG. 1. The electronic circuit 62 detects on the one hand the alternating electromagnetic field 8 which is coupled in by way of the sensor element 61, and the signal afforded by the temperature sensor 64.

When now a corresponding activation signal 8 is detected by the electronic circuit 62 it starts monitoring of the temperature by means of the signal from the sensor element 64, to ascertain whether a predetermined limit value is exceeded. When the temperature limit value is exceeded the electronic circuit 62 activates the display element 65 so that an item of optical information, for example a warning indication, is visible. The film body 6 is used for example as a label for monitoring foodstuffs and for that purpose is applied for example to the foodstuffs to be monitored or the packaging thereof, or forms part of such packaging. Besides the sensor element 64 the film body 6 may also have further sensor elements which for example detect light irradiation or oxygen content and the signals of which are checked by the electronic circuit 62 for compliance with predefined limit values.

The invention claimed is:

1. A multi-layer flexible film body comprising:

a carrier layer and a decorative layer system providing optically recognizable information, wherein the system comprises a plurality of layers forming an electrically controlled display element, by the activation of which the optically recognizable information becomes visible; wherein the plurality of layers including two electrode layers and at least one layer between the two electrode layers, the at least one layer containing at least one of an electrochromic material, an electroluminescent material, or an organic/inorganic florescent substance, and which electrode layers form an electrically controlled display element; and at least one of the electrode layers of the display element comprises an unstructured electrode layer structured by an overprinted electrically non-conducting printing material in negative form of the optically recognizable information such that the electrodes have only in the region of the optically recognizable information an electrically conductive surface which is in contact with the one electrochromic material, the electroluminescent material or the organic/inorganic fluorescent substance.

2. A multi-layer flexible film body according to claim 1 wherein the decorative layer system includes at least one layer forming a sensor element connected to the display element for detecting an applied external activation signal.

3. A multi-layer flexible film body according to claim 2 wherein the decorative layer system has an optical effect activatable by an alternating electromagnetic field as the external activation signal and the decorative layer system includes one or more electrically conductive layers forming an antenna structure for detection of the alternating electromagnetic field and which structure serves as the sensor element for detection of the alternating electromagnetic field.

4. A multi-layer flexible film body according to claim 2 wherein the decorative layer system has an optical effect activatable by an alternating electromagnetic field as the external activation signal and the decorative layer system has one or more electrically conductive layers of a plate-shaped configuration for capacitively coupling in the alternating electromagnetic field, which electrically conductive layers serve as the sensor element for the detection of the alternating electromagnetic field.

5. A multi-layer flexible film body according to claim 1 wherein the decorative layer system includes one or more layers which provide a sensor element for the detection of an external deactivation signal and the sensor element is connected to the display element directly or by way of an electronic circuit such that the display element is deactivated upon reception of the deactivation signal.

6. A multi-layer flexible film body according to claim 1 wherein the display element is adapted such that it remains activated after once being activated.

7. A multi-layer flexible film body according to claim 1 wherein the decorative layer system provides two or more different optically recognizable items of information and a plurality of layers of the decorative layer system provide two or more electrically controlled display elements, by the activation of which a respective one of the different items of optically recognizable information becomes visible.

8. A multi-layer flexible film body according to claim 1 wherein the decorative layer system has two or more layers which provide an electronic circuit, including one or more semiconductor layers applied from a solution, and the electronic circuit is connected to the display element and is so arranged that it controls activation of the display element.

9. A multi-layer flexible film body according to claim 1 wherein the decorative layer system has one or more layers which provide an electric power source connected to the display element directly or by way of a switching element.

10. A multi-layer flexible film body according to claim 9 wherein the decorative layer system one or more layers comprises two or more layers which provide an electrochemical flat battery as the electric power source.

11. A multi-layer flexible film body according to claim 1 wherein the decorative layer system has one or more electrically conductive layers which form an antenna for electromagnetic coupling-in of electromagnetic energy from an alternating electromagnetic field, wherein the antenna is connected to a capacitor and a rectifier for providing a power source for the generation of a direct current.

12. A multi-layer flexible film body according to claim 1 wherein the decorative layer system has one or more electrically conductive layers which have plate-shaped metal surfaces for capacitive coupling-in of energy from an alternating electromagnetic field, wherein the plate-shaped metal surfaces are connected to a rectifier and a capacitor for providing a power source for the generation of a direct current.

13. A multi-layer flexible film body according to claim 1 wherein the decorative layer system is arranged to form a power source that has one or more layers forming a solar cell.

14. A multi-layer flexible film body according to claim 1 wherein the decorative layer system forms a power source that has one or more layers comprising a piezoelectric material.

15. A multi-layer flexible film body according to claim 1 wherein the decorative layer system is arranged to form a power source that has one or more electrodes for receiving charge carriers generated by friction and electrostatic charging.

16. A multi-layer flexible film body according to claim 1 wherein the film body is a packaging film for packaging goods.

17. A multi-layer flexible film body according to claim 1 wherein the film body is a label.

18. The film body according to claim 1 arranged to form a label for the identification of goods.

19. The film body according to claim 1 arranged to form a label for a playing card.

20. The film body according to claim 1 arranged to form a lottery ticket .

21. The film body according to claim 1 arranged to form one of operating instructions or an information carrier.

22. The film body according to claim 1 arranged to form a label for monitoring electronic components.

23. The film body according to claim 1 arranged to form a label for monitoring foodstuffs, pharmaceutical agents and other consumer goods.

24. The film body according to claim 1 arranged to form an activatable poster.

25. A system including a multiplicity of packages for goods, which are provided with a film body forming a dynamic optical label, according to claim 1 and an activator having a sender for emitting an activation signal, wherein the multiplicity of packages comprise two or more different groups of packages such that the packages in the same group respectively have the same activatable item of information which differs from the activatable item of information of the other group or groups.

* * * * *